US010935047B2

(12) United States Patent
Berean

(10) Patent No.: US 10,935,047 B2
(45) Date of Patent: Mar. 2, 2021

(54) COMPACT AIR MOVING DEVICE

(71) Applicant: DL Manufacturing, North Syracuse, NY (US)

(72) Inventor: Kyle Berean, Canastota, NY (US)

(73) Assignee: DL Manufacturing, Inc., North Syracuse, NY (US)

( * ) Notice: Subject to any disclaimer, the term of this patent is extended or adjusted under 35 U.S.C. 154(b) by 322 days.

(21) Appl. No.: 15/624,652

(22) Filed: Jun. 15, 2017

(65) Prior Publication Data

US 2017/0363106 A1 Dec. 21, 2017

Related U.S. Application Data

(60) Provisional application No. 62/350,199, filed on Jun. 15, 2016.

(51) Int. Cl.

| | |
|---|---|
| ***F04D 29/54*** | (2006.01) |
| ***F04D 25/08*** | (2006.01) |
| ***F04D 19/00*** | (2006.01) |
| ***F04D 29/32*** | (2006.01) |
| ***F04D 29/52*** | (2006.01) |

(52) U.S. Cl.

CPC ..... *F04D 29/542* (2013.01); *F04D 19/002* (2013.01); *F04D 25/088* (2013.01); *F04D 29/325* (2013.01); *F04D 29/522* (2013.01)

(58) Field of Classification Search

CPC .... F04D 29/542; F04D 25/088; F04D 29/325; F04D 29/522; F04D 19/002

See application file for complete search history.

(56) References Cited

U.S. PATENT DOCUMENTS

| | | | | | |
|---|---|---|---|---|---|
| 2,397,171 | A * | 3/1946 | Troller | F04D 25/082 | 417/368 |
| 2,596,781 | A * | 5/1952 | Moore | F04D 19/002 | 416/213 R |
| 3,169,747 | A * | 2/1965 | Glenfield | F04D 29/666 | 415/195 |
| 4,473,000 | A * | 9/1984 | Perkins | F04D 25/088 | 454/299 |
| 5,816,781 | A * | 10/1998 | Bercot | F04D 19/002 | 417/371 |
| 10,024,531 | B2 * | 7/2018 | Avedon | F04D 29/545 | |
| 2017/0184125 | A1 * | 6/2017 | Matsui | F04D 29/542 | |

* cited by examiner

*Primary Examiner* — Joseph J Dallo
*Assistant Examiner* — Kurt Philip Liethen
(74) *Attorney, Agent, or Firm* — Barry F. Manna

(57) ABSTRACT

An air moving device includes an outer casing comprising an outer diameter, an inner portion defining a flow path, an inlet portion defining an inlet cross-sectional area, and an opposing outlet portion defining an outlet cross-sectional area. A motor assembly is disposed within the outer casing, and a hub and blade assembly is secured to a shaft on the motor assembly. The air moving device further includes a de-swirl vane package. The package includes a plurality of de-swirl vanes disposed in the flow path. The blades are characterized by one or more resonant frequencies, and a potential excitation source of the blade resonant frequencies is a flow path obstruction comprising a plurality of objects substantially equally spaced about the circumference of the flow path. The flow path obstruction is characterized by a periodic frequency. The periodic frequency differs from the blade resonant frequencies by a safety margin of at least 20%.

22 Claims, 6 Drawing Sheets

COMPACT AIR MOVING DEVICE

CROSS REFERENCE TO RELATED APPLICATION

Reference is made to and this application claims priority from and the benefit of U.S. Provisional Application Ser. No. 62/350,199, filed Jun. 15, 2016, entitled "COMPACT AIR MOVING DEVICE", which application is incorporated herein in its entirety by reference.

BACKGROUND OF THE INVENTION

This disclosure relates generally to an air moving device and, more specifically, to an air moving device having laminar, high velocity flow over long distances.

Large industrial spaces such as warehouses or factory floors may have a clear height of 32 feet or more (the dimension from the floor to the bottom of an obstruction hanging from the ceiling; examples include joists, light fixtures, heaters, or sprinkler heads). Heating or cooling this vast area is difficult, and results in thermal gradients from the floor to the ceiling as warm air rises and cooler air is pushed downward. Often, an industrial HVAC system may suffer from dead spots having little to no circulation.

Ceiling fans have been utilized to alleviate some of the discomfort associated with dead spots or thermal gradients, but due to the great height at which they must be installed, they are largely ineffective because the fan air dissipates in large part before reaching the floor. Large diameter, slow spinning fans have also been utilized, but due to their enormous size (e.g., 20 foot diameter) they are difficult to position and may interfere with existing lighting, HVAC, or sprinklers. The large diameter fans move a large volume of air at a relatively low speed. This may help alleviate thermal gradients, but the lack of velocity does little to provide comfort to a worker on the factory floor, who just needs to feel a breeze.

SUMMARY OF THE INVENTION

The air moving device disclosed herein provides a compact, small-footprint device that moves a relatively small volume of air in a laminar column at high velocity. When mounted on a factory ceiling, the device (one prototype measuring only 18" in diameter and 4 feet in length) blows air in a relatively intact column straight down to the floor, allowing the floor to disperse the flow uniformly in all directions. The resulting flow distribution provides a comfortable breeze (e.g., up to 600 fpm, 7 mph) about five feet above the floor over a distance of 60 feet from the centerline of the air moving device.

The air moving device includes an outer casing or shroud to condition the discharge air downstream from a fan section. The shroud includes a de-swirl vane package comprising a plurality of vanes configured to convert the rotational component of the discharge air velocity to a substantially axial component. The vanes may be further configured to accelerate the flow in the axial direction, thereby increasing the flow velocity.

In one aspect of the invention, an air moving device includes an outer casing comprising an outer diameter, an inner portion defining a flow path, an inlet portion defining an inlet cross-sectional area, and an opposing outlet portion defining an outlet cross-sectional area. A motor assembly is disposed within the outer casing, and a hub and blade assembly is secured to a shaft on the motor assembly. The air moving device further includes a de-swirl vane package. The package includes a plurality of de-swirl vanes disposed in the flow path, wherein the outlet cross-sectional area is substantially equal to or greater than the inlet cross-sectional area.

In one example, the air moving device further includes an inlet cowl disposed within the inlet portion. The inlet cowl is configured to provide a smooth transition for air entering the inlet portion of the air moving device.

In another example, the blades may be characterized as having one or more resonant frequencies. A potential source of excitation of the blade resonant frequencies may be a downstream vane passing frequency. In one embodiment of the invention, the vane passing frequency is a safe margin away from the blade resonant frequencies.

In one example, the vane passing frequency comprises a subharmonic of a fundamental vane passing frequency.

In another aspect of the invention, an air moving device includes an outer casing comprising an outer diameter, an inner portion defining a flow path, an inlet portion defining an inlet cross-sectional area, and an opposing outlet portion defining an outlet cross-sectional area. A motor assembly is disposed within the outer casing, and a hub and blade assembly is secured to a shaft on the motor assembly. The air moving device further includes a de-swirl vane package. The package includes a plurality of de-swirl vanes disposed in the flow path. The blades are characterized by one or more resonant frequencies, and a potential excitation source of the blade resonant frequencies is a flow path obstruction comprising a plurality of objects substantially equally spaced about the circumference of the flow path. The flow path obstruction is characterized by a periodic frequency. The periodic frequency differs from the blade resonant frequencies by a safety margin of at least 20%.

In one example, the number of rotating blades have no common factors with the number of downstream de-swirl vanes. A common factor is defined as the largest factor that divides the two numbers.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
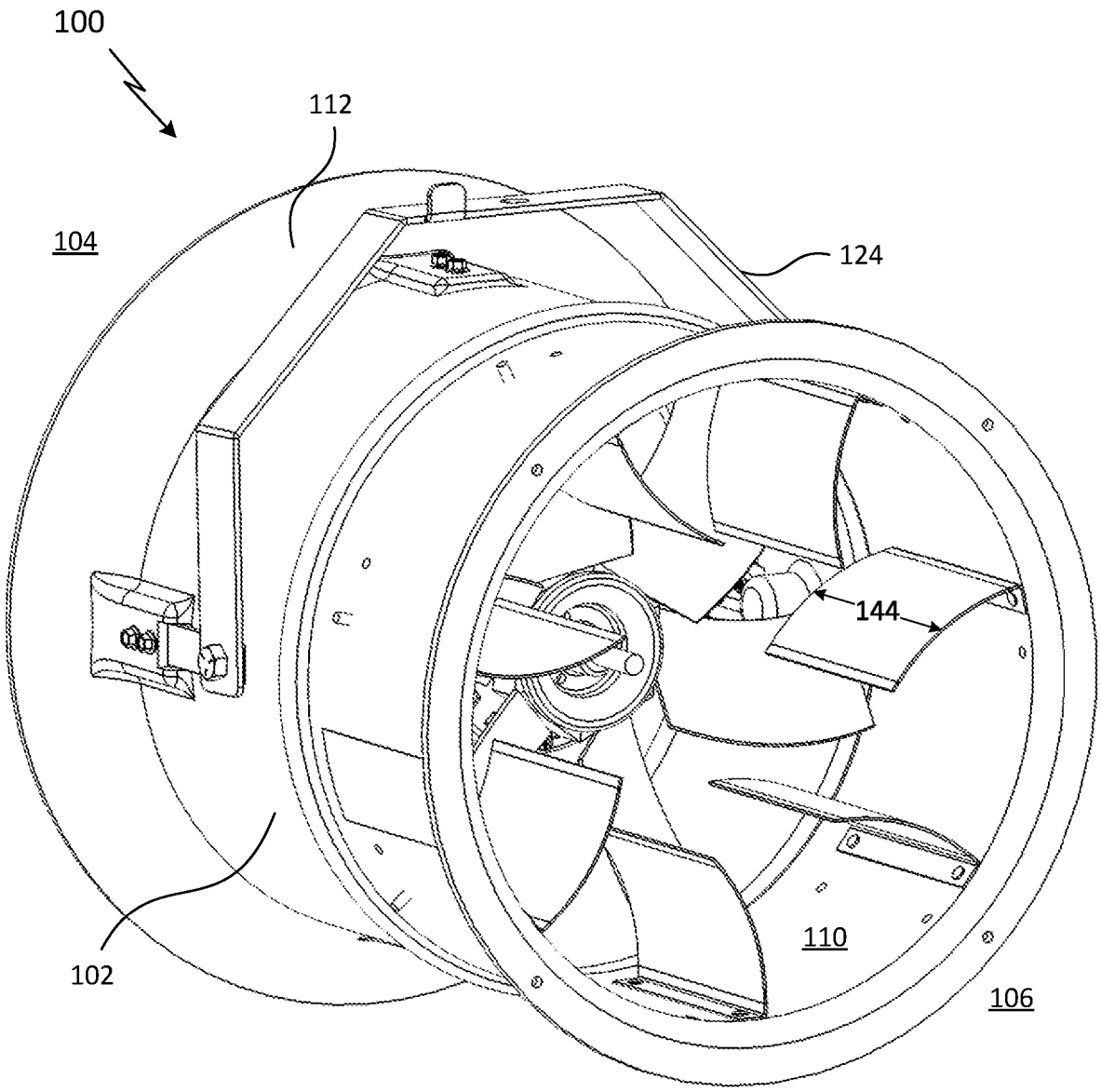
FIG. 1 depicts a perspective view of an air moving device according to one embodiment of the invention.
Figure 2:
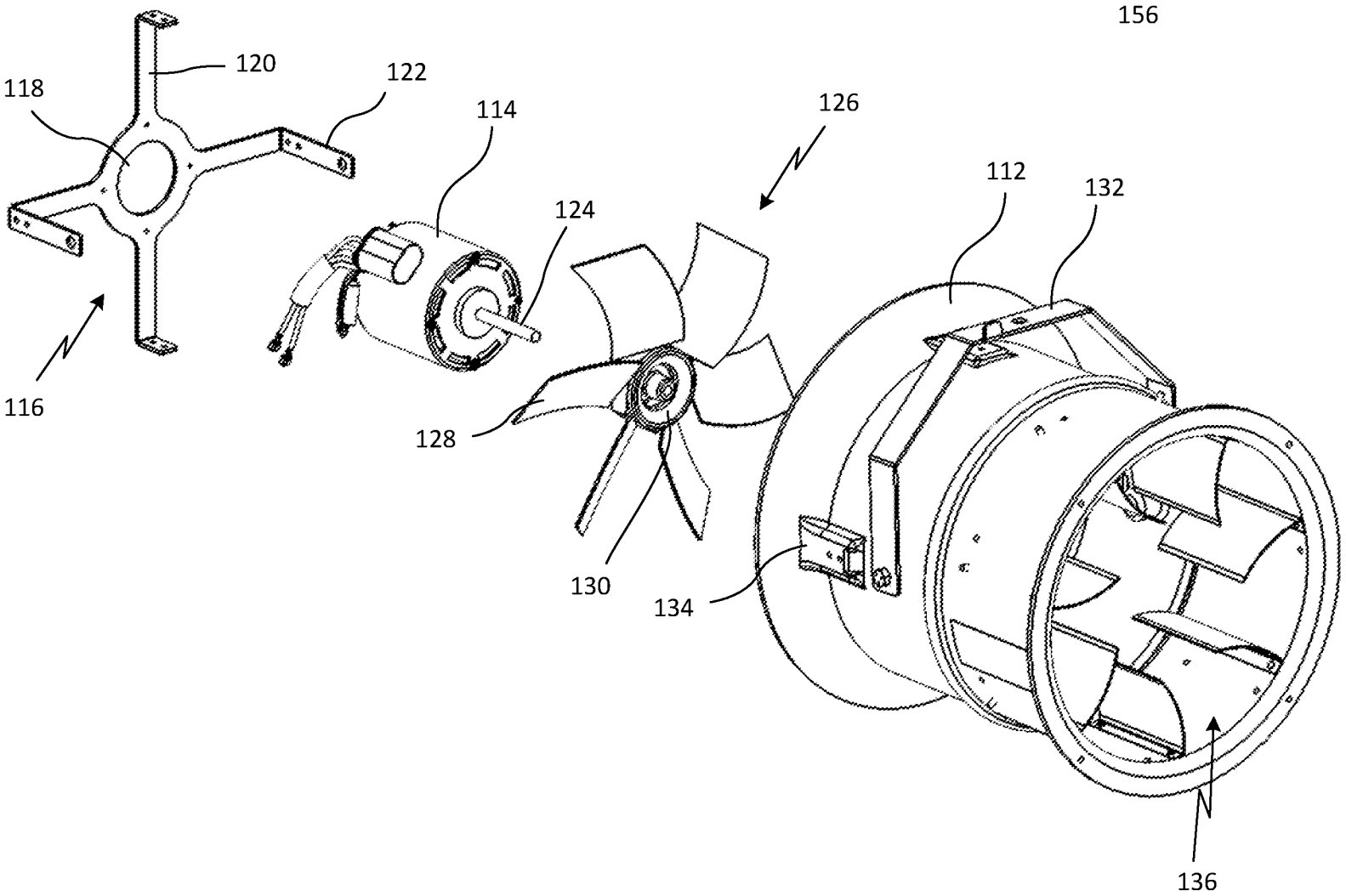
FIG. 2 depicts an exploded perspective view of the air moving device shown in FIG. 1.
Figure 3:
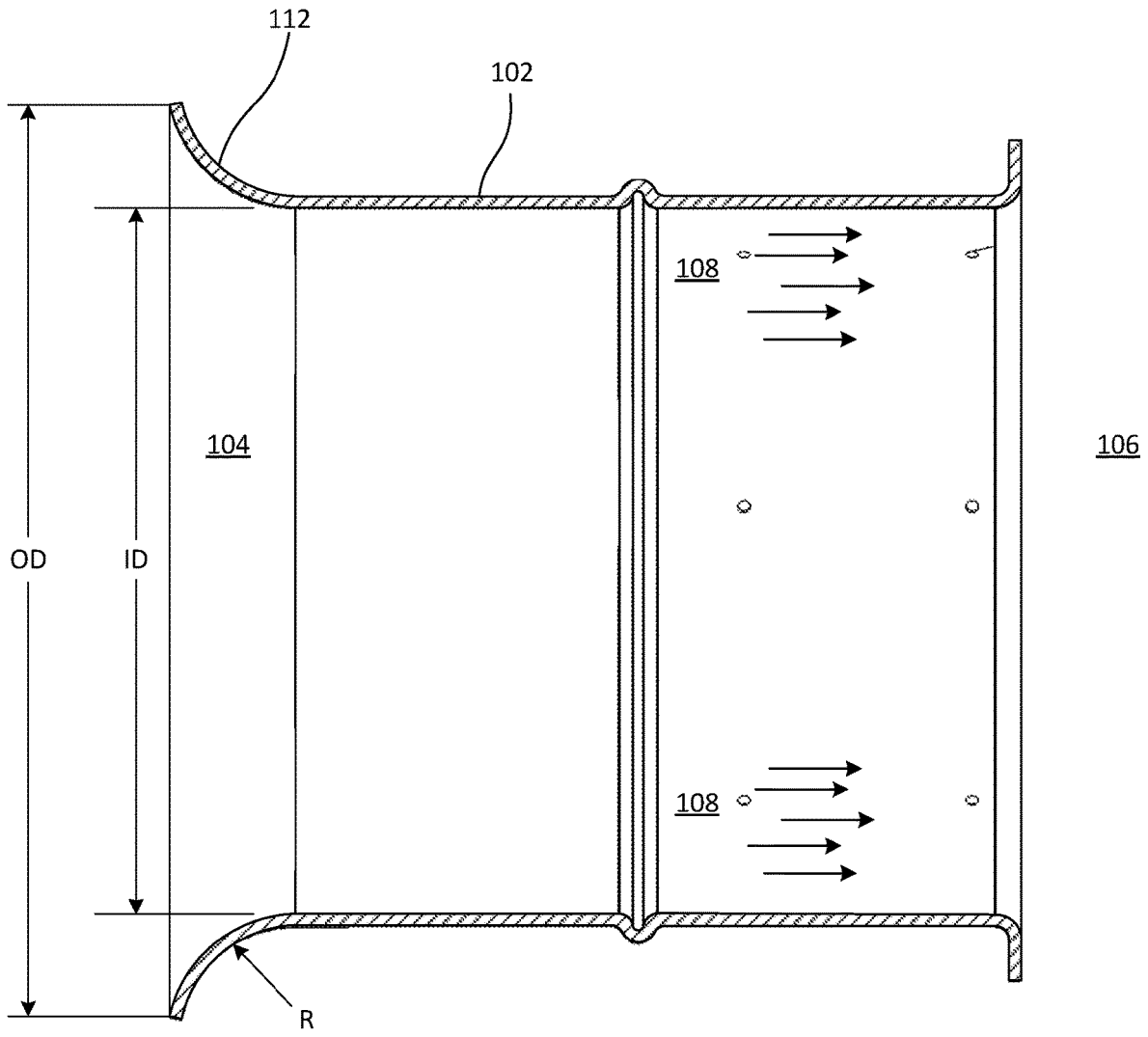
FIG. 3 depicts a side cross-sectional view of the outer casing shown in FIG. 2.

Referring to FIGS. 1-3, in one embodiment of the invention, an air moving device 100 includes a structural outer casing 102 having an air inlet portion 104, an opposing air outlet portion 106, and defining a flow path 108 therethrough. The inner surface 110 of the outer casing 102 defines the outer flow path boundary. In one embodiment of the invention, the outer casing 102 is approximately 18.5 inches in diameter and 48 inches in length, leaving a radial blade tip gap (γ) of approximately 3/16 inches (see FIG. 4, assuming the outer casing is 1/16 inches thick). The cylindrical outer casing 102 may be fabricated from high strength plastic, fiberglass, aluminum, or sheet metal, for example.

In one embodiment of the invention, the cross-sectional area of the flow path 108 remains substantially constant downstream through the length of the outer casing 102. In one example, the flow path outer diameter (e.g., inner surface 110 of outer casing 102) does not decrease aft of the blade exit. Other fan assemblies known in the art disclose the cross-sectional area of the outlet being between 75% to 95% of the cross-sectional area of the inlet (or less), presumably to create back pressure on the inlet portion to increase the efficiency of the fan. However, the configuration disclosed herein does not benefit from a reduced cross-sectional exit area and, in some experiments, actually decreased the performance of the fan.

In another embodiment of the invention, the outer casing 102 is approximately 50 inches in diameter and 42 inches in length, leaving a blade gap (γ) of approximately 7/8 inches (assuming the outer casing is 1/8 inches thick).

Figure 6:
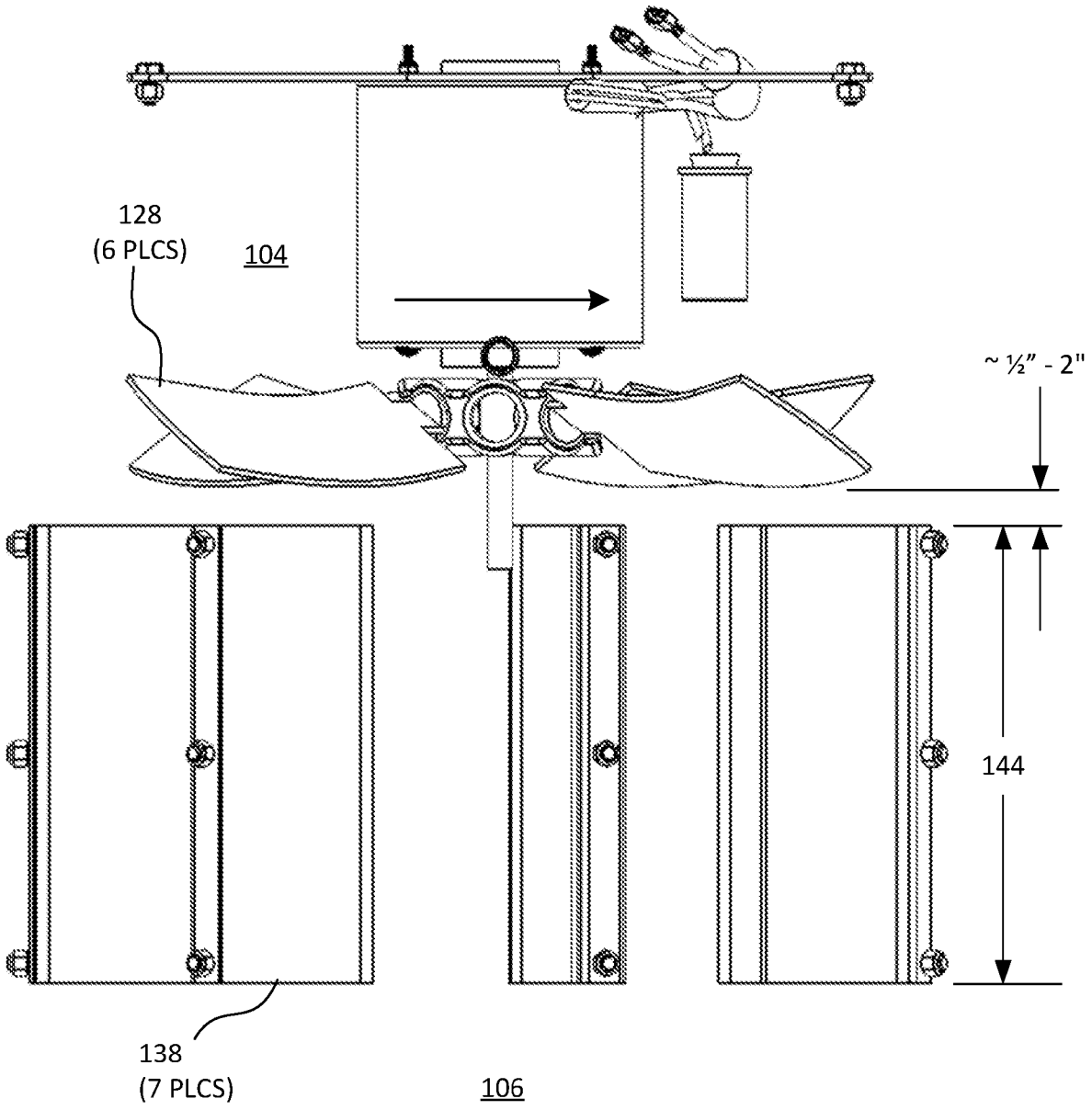
FIG. 6 depicts a side plan view of the air moving device shown in FIG. 1, with the outer casing removed for clarity, and rotated to a vertical orientation, such as for mounting to a ceiling.

An inlet cowl 112 may cooperate with the outer casing 102 to provide a smooth transition for air flow entering the inlet portion 104 of the air moving device 100. As best illustrated in side cutaway view of FIG. 6, the inlet cowl 112 may transition from an outer diameter (OD) to an inner diameter (ID) along an annular surface defined by a radius (R). In the illustrated embodiment, the inlet cowl 112 is fabricated integral with the outer casing 102. In other embodiments, the inlet cowl 112 may comprise a separate, interchangeable component fastened to the outer casing 102 by screws or the like. The inlet cowl 112 may be fabricated from plastic, fiberglass, or aluminum, for example.

A motor assembly 114 is centered and securely positioned within the outer casing 102, held in place by a mounting frame 116. In one example, the mounting frame 116 includes a center frame portion 118 that fastens to the back face of the motor assembly 114. A plurality of support arms 120 or struts extend radially outwards from the center frame portion 118 and bolt to the outer casing 102. The tip of each support arm 120 may be bent at a right angle to provide a bolting plate 122. The motor assembly 114 includes a shaft 124 to which a blade assembly 126 is secured. In the illustrated embodiment, the blade assembly 126 includes six radially-extending metal blades 128 equally spaced about a hub 130. In one example, the outer diameter of the blades 128 is approximately 18 inches. In another example, the outer diameter of the blades 128 is approximately 48 inches.

The air moving device 100 may further include a holding bracket 132 secured to the outer casing 102 with fasteners, such as a bolt and nut. A plurality of bolt holes allow the bracket 132 to be adjusted axially, close to the center of gravity of the air moving device 100. Alternatively, the holding bracket 132 may be loosened to allow rotation of the bracket, so the air moving device 100 may be positioned or hung in a vertical orientation. For vertical positioning, the outer casing 102 may include stand-offs 134 to fix the position of the bracket 132 and allow re-fastening.

Figure 4:
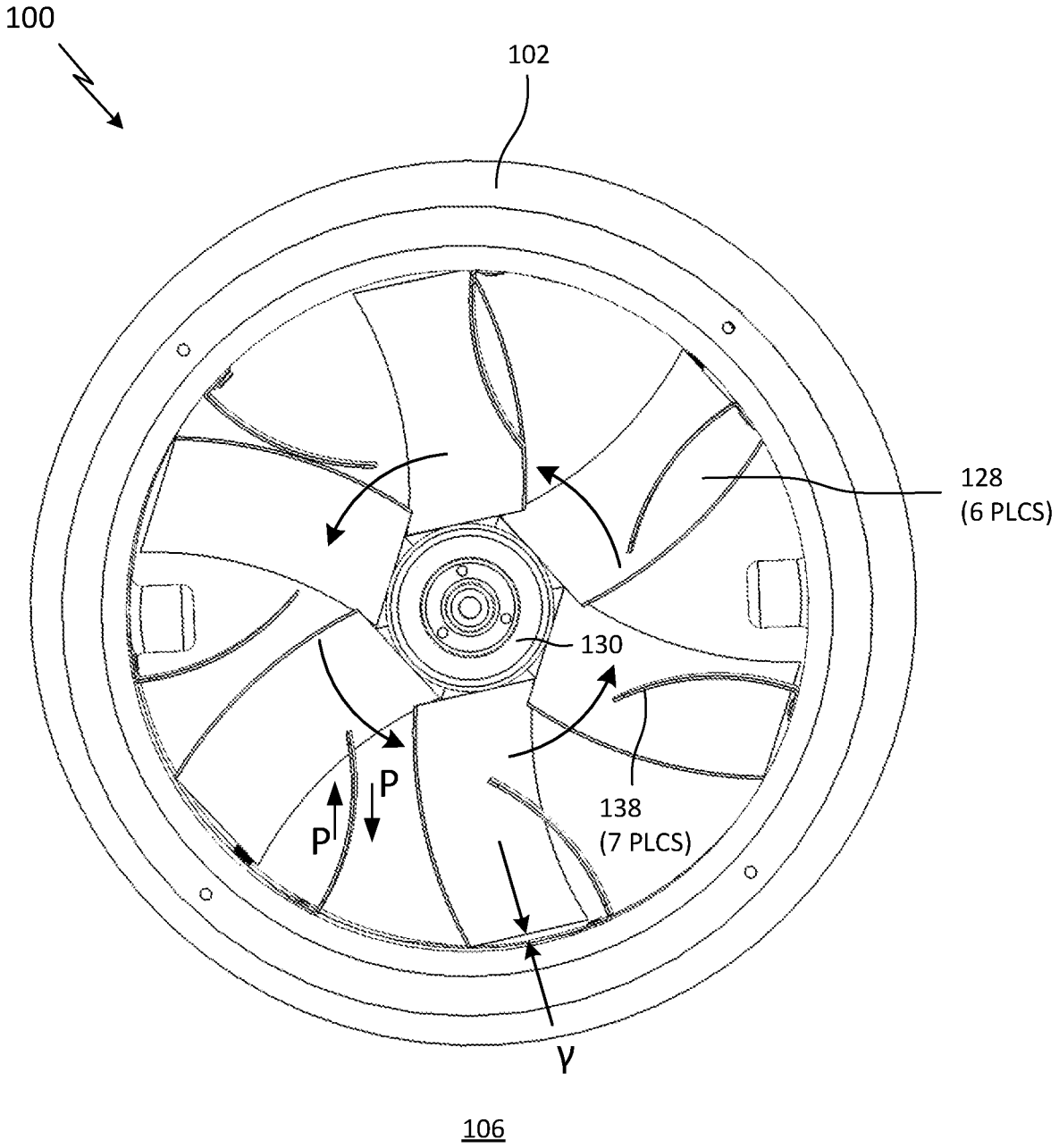
FIG. 4 depicts an end view of the air moving device shown in FIG. 1.

The air moving device 100 may further include a de-swirl vane package 136 at the outlet portion 106 of the device to straighten the exit flow of the fan. FIG. 4 illustrates an end view of the outer casing 102, blade assembly 126, and de-swirl vane package 136, looking from the outlet portion 106 toward the inlet portion 104. The direction of rotation of the fan hub 130 is shown by the four arrows. The blades 128 may be of any design suited for the application, but the number of blades in the blade assembly 126 can be critical to the durability of the air moving device 100. In the illustrated embodiment of the invention, the blade assembly 126 comprises four blades 128 and the de-swirl vane package 136 comprises seven de-swirl vanes 138.

Figure 5:
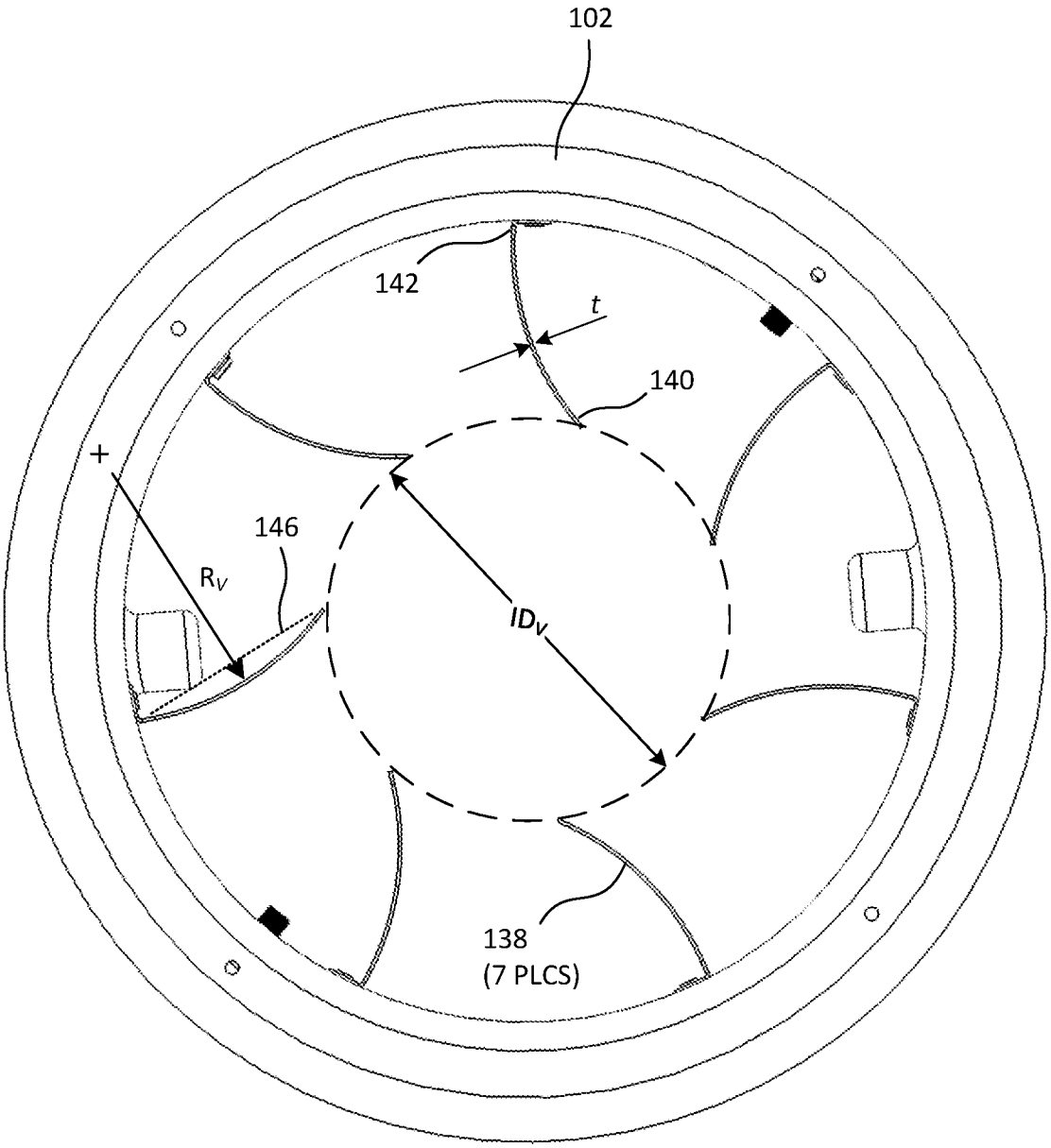
FIG. 5 depicts the end view of the air moving device shown in FIG. 4, with the rotating components removed.

Referring to FIG. 5, in one embodiment of the invention each de-swirl vane 138 may comprise a tip portion 140 located at an inner radius of the flow path 108, and a root portion 142 located at an outer radius of the flow path 108. The root portion 142 may be secured to the outer casing 102 by conventional fasteners, so that the de-swirl vanes 138 are cantilevered from the root portion 142 and extend radially inward. The de-swirl vanes 138 may be formed from sheet metal having a constant thickness (t), and the axial length 144 (FIG. 1) of the vane may be greater than its chord length 146. The de-swirl vane 138 may be formed into an airfoil shape or, as illustrated, bent to form a constant radius ($R_V$) to approximate an airfoil shape. In one embodiment, wherein the diameter of the outer casing 102 is approximately 18.5 inches, the vane axial length 144 may be in a range between 5.0-12.0 inches, and the vane radius ($R_V$) may be in a range of approximately 5.0-11.0 inches. The chord length 146 may be a length appropriate to establish an inner diameter ($ID_V$) of the de-swirl vane package 136 in a range between 6.0 inches and 10.5 inches. For example, the chord length 146 may be in a range from 3.6-7.0 inches.

The configuration disclosed herein is thought to be scalable. Therefore, in another embodiment of the invention, the de-swirl vane 138 may be formed into a constant radius ($R_V$) to approximate an airfoil shape, and the vane axial length 144 may be in a range between 25% and 65% of the diameter of the outer casing 102, and the vane radius ($R_V$) may be in a range between 25% and 60% of the outer casing diameter. The chord length 146 may be a length appropriate to establish an inner diameter ($ID_V$) of the de-swirl vane package 136 in a range between 30% and 60% of the outer casing diameter. For example, the chord length 146 may be in a range between 20% and 40% of the outer casing diameter.

In operation, air is drawn into the inlet cowl 112 of the air moving device 100 where its velocity and pressure are increased by the blade assembly 126. The air flow discharging off the blade assembly 126 has a high degree of swirl. That is, a velocity vector at any given time would include an axial component and a large radial component. In addition, due to the centrifugal nature of the fan, a majority of the discharge mass flow is concentrated radially outward on the outer one-third of the outlet portion 106. The radial component of the discharge flow impinges on the leading edge of the de-swirl vanes 138, from the root portion 142 to the tip portion 140, creating a higher dynamic pressure (↑P) on the concave surface of each vane 138 and a lower dynamic pressure (↓P) on the convex surface. As the axial component of the discharge flow carries the air mass towards the outlet portion 106, the de-swirl vanes 138 convert the radial component to an axial component, and the pressure differential across each vane accelerates the flow. Due to the axial length of the de-swirl vanes 138, the flow exiting the outlet portion 106 is substantially laminar, axially-oriented, and at a substantially higher velocity than the air flow discharging off the blade assembly 126.

Example 1

In one experiment, air velocity measurements were recorded with and without the de-swirl vane package 136 installed in the outer casing 102. The measurements were recorded at a distance of 17 feet from the outlet portion 106 of the air moving device 100. The air velocity without the de-swirl vane package 136 was 300 fpm (3.4 mph), and the air velocity with the de-swirl vane package 136 was 1000 fpm (11.4 mph), a threefold increase. In addition, the columnar flow had a sharp edge boundary, meaning the velocity dropped off rapidly radially outboard of the flow column, defined by the outer casing diameter.

The disclosed air moving device thus provides a compact air mover mountable to the ceiling of an industrial work area to provide a localized, high-velocity, laminar air flow for industrial workers. Even when the air moving device is mounted at a height of 32 feet, the device delivers a noticeable breeze to workers up to 60 feet away, which aides in evaporative cooling and makes the workplace more comfortable. Although the disclosed air moving device draws in ambient air from the upper ceiling region of the factory space, it could also be configured to provide heated air in the colder months or air-conditioned air in the warmer months.

Good engineering practice dictates that consideration be given to a fan's dynamic characteristics to minimize vibration problems while in operation. For example, designers may examine fan blade vibration response caused by any number of possible excitation sources, such as rotordynamic vibration, blade flutter, vortex shedding, rotating cavitation, and blade passing excitation, to name a few.

Blade passing excitation typically arises from rotor-stator interaction, such as a row of stator vanes operating just downstream of a row of rotating blades. The wakes from the upstream blades provide a pressure pulse on each vane. The pressure pulses are thus in the form of a periodic excitation at a frequency related to multiples (i.e., harmonics) of the rotor speed. For example, a fan rotor having six blades would set up a periodic excitation of six pulses per revolution on each vane. If the frequency of the excitation source is close to the resonant frequency of the vane, a sympathetic resonance sets up and, similar to a tuning fork, large amplitude vibrations would ensue. As the energy in the excitation source continues to feed the resonance, structural failure of the vane becomes imminent through high cycle fatigue, similar to a paper clip repeatedly bent back and forth.

The simplest form of blade passing excitation fundamental frequency may be expressed as:

$$F_{pass}=(N_B\times\Omega)/60\ (\text{Hz}) \tag{1}$$

where $N_B$ is the number rotating blades, and $\Omega$ is rotor speed in rpm.

Also of concern are higher harmonics or multiples of the fundamental frequency, expressed as:

$$F_{harm}=m\times(N_B\times\Omega)/60\ (\text{Hz}) \tag{2}$$

where m is an integer such as 2, 3, etc. The higher harmonics are still capable of exciting the vane's resonant frequency. As a practical matter, though, designers typically only take into consideration values of m up to 3.

In addition to higher-order harmonics, subharmonics of the fundamental frequency are of great concern. Subharmonic blade passing frequencies arise from the combination and interaction of the number of rotating blades ($N_B$) and the number of stationary vanes ($N_V$). In particular, when the integers $N_B$ and $N_V$ have a common factor, defined as the largest factor that divides the two numbers, a specific pattern of excitation is repeated at a subharmonic frequency of the fundamental frequency, expressed as:

$$F_{subh}=(N_B\times\Omega)/(N_{CF}\times 60)(\text{Hz}) \tag{3}$$

where $N_{CF}$ is the common factor between $N_B$ and $N_V$.

Subharmonics of the fundamental frequency are of great concern because they occur at a lower frequency, and thus may be closer to the vane's resonant frequency. In addition, subharmonic frequencies can be more detrimental than the fundamental frequency or its harmonics because fluid and structural damping is not as effective at the lower frequencies.

In summary, fan designers are primarily concerned with energy sources that excite the fan blade at its resonant frequency, such as upstream guide vanes or mechanisms external to the aerodynamics. Fan designers also analyze the blade's aerodynamic performance as an energy source for downstream excitation, such as a rotating blade's wake setting up resonance in downstream stationary vanes. Low-speed fan designers are typically not concerned with downstream perturbations affecting upstream blade resonant frequencies, since there is usually not enough energy in the system to travel backwards (i.e., upstream) and serve as an excitation source.

However, in one embodiment of the invention, downstream vane passage excitation frequencies are an important consideration. The inventor has recognized that the de-swirl vanes 138 are axially positioned in close proximity to the rotating blades, i.e., approximately ½"-2", so as to preserve a low-profile axial length yet still achieve high fan performance. In addition, the de-swirl vanes 138 are heavily loaded, that is, there is a strong pressure differential across the vanes. As shown in FIG. 4, the concave surface of each vane 138 is at a higher dynamic pressure (↑P) than the convex surface (↓P). As a result, with each revolution the rotating blades 128 are believed to encounter n pressure pulses emanating from the downstream flow dynamics on the de-swirl vanes 138, where n equals the number of vanes in the de-swirl vane package 136. The pressure pulses on each blade 128 are realized as a periodic excitation at a frequency related to multiples (i.e., harmonics) of the rotor speed.

It is an object of the present invention, then, to assure that excitation frequencies arising from upstream or downstream periodic flow path obstructions are well out of the range of potential dynamic resonances of the rotating system (i.e., at least a 20% safety margin) as well as the natural or resonant frequency of the blade 128. Examples of periodic flow path obstructions include the upstream support arms 120 of the mounting frame 116, and the downstream vane passing excitation frequencies, including the fundamental vane passing frequency, its superharmonics, and its subharmonics.

One method by which to accomplish this is to design an air moving device 100 wherein the number ($N_B$) of rotating blades 128 have no common factors with the number ($N_V$) of downstream de-swirl vanes 138, thus eliminating the possibility of blade subharmonic excitation.

Example 2

An early prototype air moving device 100 comprised four blades 128 rotating at 2000 rpm, and six downstream de-swirl vanes 138.

The vane passing excitation fundamental frequency may be expressed as:

$$F_{pass}=(N_V\times\Omega)/60=(6\times2000)/60=200\text{ Hz} \quad (1)$$

The higher harmonics or multiples of the fundamental frequency may be expressed as:

$$F_{harm}=m\times(N_V\times\Omega)/60=m\times200\text{ Hz}=400\text{ Hz},600\text{ Hz},\text{etc.} \quad (2)$$

To calculate the subharmonic fundamental frequency, the common factor must be determined:

Number of blades($N_B$)=4=$\boxed{2}\times2$;

Number of vanes($N_V$)=6=$\boxed{2}\times3$;

Common Factor($N_{CF}$)=$\boxed{2}$.

Then, applying Eq. (3) above for a vane excitation on a rotating blade:

$$F_{subh}=(6\times2000)/(2\times60)=100\text{ Hz} \quad (3)$$

Since the hub 130 is spinning at 2000 rev/min or 33.3 rev/sec, the 100 Hz excitation frequency is a third modal of the speed (m=100/33.3=3) and therefore poses a risk for potential resonance. The configuration should not be adopted.

Example 3

A second prototype air moving device 100 comprised an outer casing 102 approximately 17.5 inches in axial length 144, and 18.5 inches in diameter. The blade assembly 126 measured 18.0 inches in diameter and included four blades 128. The air moving device 100 included seven de-swirl vanes 138 spaced approximately 0.5 inches from the exit plane of the blade assembly 126. Each de-swirl vane 138 was formed of thin sheet metal, having an axial length 144 of 9.0 inches, a chord length 146 of approximately 4.25 inches, and a radius ($R_V$) of approximately 5.4 inches, such that the inner diameter of the de-swirl vane package 136 was approximately 9.75 inches.

The vane passing excitation fundamental frequency may be expressed as:

$$F_{pass}=(N_V\times\Omega)/60=(7\times2000)/60=233\text{ Hz} \quad (1)$$

The higher harmonics or multiples of the fundamental frequency may be expressed as:

$$F_{harm}=m\times(N_V\times\Omega)/60=m\times200\text{ Hz}=466\text{ Hz},700\text{ Hz},\text{etc.} \quad (2)$$

To calculate the subharmonic fundamental frequency, the common factor must be determined:

Number of blades($N_B$)=4=2×2;

Number of vanes($N_V$)=7=7×1;

Common Factor($N_{CF}$)=$\boxed{1}$.

Then, applying Eq. (3) above for a vane excitation frequency on the blade:

$$F_{subh}=(7\times2000)/(1\times60)=233\text{ Hz} \quad (3)$$

The 233 Hz subharmonic excitation frequency is a higher order modal of the speed (m=233/33.3=7) and therefore poses no risk of inducing a dynamic resonance. Assuming the $F_{pass}$, $F_{harm}$, and $F_{subh}$ excitation frequencies are well out of the range of the first, second, and third natural frequencies of the blade (which may be determined using computer modeling techniques, bench testing, and a Campbell diagram, for example) the configuration is acceptable.

The disclosed air moving device offers many improvements over other devices known in the art. First, the device is compact with a small footprint, permitting installation virtually anywhere without interfering with existing lighting, HVAC, or sprinklers. Second, the air moving device utilizes the factory floor space to disperse the air flow, rather than on-unit louvres and the like that add complexity and cost. Third, the dispersal pattern provides a strong, comfortable breeze up to 60 feet away from the centerline of the air moving device. Fourth, the air flow rate (CFM) of the disclosed air moving device is only about one-tenth that of the large diameter, slow spinning fans. As a result, a smaller fan motor can be utilized, which reduces unit cost and is cheaper to operate.

The invention claimed is:

1. An air moving device, comprising:

an outer casing comprising an outer diameter, an inner portion defining a flow path, an inlet portion defining an inlet cross-sectional area, and an opposing outlet portion defining an outlet cross-sectional area, and;

a motor assembly disposed within the outer casing;

a hub and blade assembly secured to the motor assembly, the blade assembly comprising a plurality of radially-extending blades characterized by one or more resonant frequencies; and a de-swirl vane package positioned in close proximity to the blades, comprising a number of equally-spaced de-swirl vanes disposed in the flow path;

wherein the outlet cross-sectional area is equal to or greater than the inlet cross-sectional area; and wherein the number of de-swirl vanes in close proximity to the blades are characterized by a periodic frequency that is a safe margin above or below the one or more blade resonant frequencies.

2. The air moving device according to claim 1, further comprising an inlet cowl disposed within the inlet portion, the inlet cowl configured to provide a smooth transition for air entering the inlet portion of the air moving device.

3. The air moving device according to claim 2, wherein the inlet cowl is further configured to pressurize the air flow.

4. The air moving device according to claim 3, wherein the inlet cowl transitions from an outer diameter (OD) to an inner diameter (ID) along an annular surface defined by a radius (R).

5. The air moving device according to claim 1, wherein the de-swirl vanes are constant thickness.

6. The air moving device according to claim 1, wherein the de-swirl vanes comprise a tip portion and an opposing root portion, and the root portion is secured to the outer casing.

7. The air moving device according to claim 6, wherein the de-swirl vanes are cantilevered from the root portion and extend radially inward.

8. The air moving device according to claim 1, wherein the de-swirl vanes are characterized by an axial length being greater than a chord length.

9. The air moving device according to claim 8, wherein the axial length of the de-swirl vane is in a range between 5.0 inches and 12.0 inches.

10. The air moving device according to claim 8, wherein the axial length of the de-swirl vane is in a range between 25% and 65% of the diameter of the outer casing.

11. The air moving device according to claim 8, wherein the chord length of the de-swirl vane is in a range between 3.6 inches and 7.0 inches.

12. The air moving device according to claim 8, wherein the chord length of the de-swirl vane is in a range between 20% and 40% of the outer casing diameter.

13. The air moving device according to claim 1, wherein the de-swirl vanes are formed into an airfoil shape characterized by a constant radius ($R_V$).

14. The air moving device according to claim 13, wherein the radius is in a range between 5.0 inches and 11.0 inches.

15. The air moving device according to claim 13, wherein the radius is in a range between 25% and 60% of the outer casing diameter.

16. The air moving device according to claim 1, wherein the periodic frequency is at least 20% higher or lower than the one or more blade resonant frequencies.

17. The air moving device according to claim 1, wherein the periodic frequency comprises a fundamental frequency or multiple thereof.

18. The air moving device according to claim 1, wherein the periodic frequency comprises a subharmonic of a fundamental vane passing frequency.

19. The air moving device according to claim 18, wherein the subharmonic periodic frequency is a higher order modal of the rotor speed.

20. The air moving device according to claim 18, wherein the subharmonic periodic frequency is greater than a third order modal of the rotor speed.

21. The air moving device according to claim 1, wherein the number of blades have no common factors with the number of de-swirl vanes.

22. The air moving device according to claim 1, wherein the de-swirl vane package is positioned 0.5 inches to 2.0 inches from the blades.

* * * * *